US007573187B2

(12) United States Patent
Lee et al.

(10) Patent No.: US 7,573,187 B2
(45) Date of Patent: Aug. 11, 2009

(54) ELECTRON EMISSION DEVICE AND ELECTRON EMISSION DISPLAY HAVING THE ELECTRON EMISSION DEVICE

(75) Inventors: Sang-Jo Lee, Yongin-si (KR); Chun-Gyoo Lee, Yongin-si (KR); Sang-Ho Jeon, Yongin-si (KR); Jin-Hui Cho, Yongin-si (KR); Sang-Hyuck Ahn, Yongin-si (KR); Su-Bong Hong, Yongin-si (KR); Byung-Gil Jea, Yongin-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 11/685,129

(22) Filed: Mar. 12, 2007

(65) Prior Publication Data

US 2007/0267954 A1 Nov. 22, 2007

(30) Foreign Application Priority Data

May 18, 2006 (KR) ..... 10-2006-0044790

(51) Int. Cl.
*H01J 63/04* (2006.01)
*H01J 1/46* (2006.01)
*H01J 1/62* (2006.01)

(52) U.S. Cl. ..... 313/310; 313/293; 313/496; 313/498

(58) Field of Classification Search ..... 313/495–497
See application file for complete search history.

(56) References Cited

U.S. PATENT DOCUMENTS 6,060,841 A * 5/2000 Niiyama et al. ..... 315/169.3
6,420,827 B1 * 7/2002 Lee et al. ..... 313/496
2003/0127988 A1 * 7/2003 Jo et al. ..... 315/169.3
2004/0036409 A1 * 2/2004 Oh et al. ..... 313/495
2004/0130258 A1 * 7/2004 Oh ..... 313/495
2005/0116610 A1 * 6/2005 Jung et al. ..... 313/495
2005/0168128 A1 * 8/2005 Kang ..... 313/495
2005/0242704 A1 * 11/2005 Lee et al. ..... 313/495
2005/0242707 A1 * 11/2005 Hwang ..... 313/497

FOREIGN PATENT DOCUMENTS

JP 09-092131 * 4/1997

* cited by examiner

*Primary Examiner*—Sikha Roy
*Assistant Examiner*—Tracie Y Green
(74) *Attorney, Agent, or Firm*—Christie Parker & Hale LLP

(57) ABSTRACT

An electron emission device and an electron emission display having the electron emission device. The electron emission device includes a substrate, a cathode electrode disposed on the substrate, and an electron emission region electrically connected to the cathode electrode. The cathode electrode includes a sub-electrode disposed on the substrate, a sub-insulation layer disposed on the sub-electrode, a main electrode disposed on the sub-electrode and having an opening for exposing a portion of the sub-insulation layer at each of a plurality of unit pixels, a plurality of isolation electrodes disposed on the sub-insulation layer in the opening of the main electrode and spaced apart from the main electrode, and a resistive layer disposed between the main electrode and the isolation electrodes to electrically connect the main electrode to the isolation electrodes.

20 Claims, 2 Drawing Sheets

ELECTRON EMISSION DEVICE AND ELECTRON EMISSION DISPLAY HAVING THE ELECTRON EMISSION DEVICE

CROSS-REFERENCE TO RELATED APPLICATION

This application claims priority to and the benefit of Korean Patent Application No. 10-2006-0044790, filed on May 18, 2006, in the Korean Intellectual Property Office, the entire content of which is incorporated herein by reference.

BACKGROUND OF THE INVENTION

1. Field of the Invention

The present invention relates to an electron emission device having a resistive layer and an electron emission display having the electron emission device.

2. Description of Related Art

Electron emission elements are arrayed on a first substrate to form a conventional electron emission device. The electron emission device is combined with a second substrate, on which a light emission unit having phosphor layers and an anode electrode is formed, to establish a conventional electron emission display.

In the electron emission device, a cathode electrode is electrically connected to electron emission regions to supply a current to the electron emission regions. When a drive voltage is applied to the cathode electrode, electrons are emitted from the electron emission regions by an electric field. Here, when the drive voltage applied to the cathode electrode is unstable and/or there is a voltage drop in the cathode electrode, there may be a voltage difference between the electron emission regions which are located at unit pixels. Then, since a discharge current of the electron emission regions may not be uniform, a light emission uniformity of the unit pixels may be deteriorated.

In order to solve the above problem, the number of electron emission regions at each of the unit pixels may be increased and/or a resistive layer may be formed between the cathode electrode and the electron emission regions to control an intensity of the discharge current.

Here, the cathode electrode includes first and second electrodes disposed on an identical plane but spaced apart from each other. The first and second electrodes are interconnected by the resistive layer. The electron emission regions are formed on the first electrode or the second electrode.

However, the first electrode has openings. Therefore, an effective width (i.e., an electrode width for contributing to a current flow in a unit pixel) of the first electrode is reduced, and thus a line resistance of the first electrode becomes greater than that of the second electrode.

Therefore, since the increased line resistance of the first electrode is not substantially compensated by the resistive layer, the ability of the resistive layer to effectively control light emission uniformity is deteriorated. As a result, in the conventional electron emission display, the light emission uniformity of the unit pixels is deteriorated along a length of the first electrode due to a voltage drop of (or in) the first electrode.

SUMMARY OF THE INVENTION

Aspects of the present invention respectively provide an electron emission device that can uniformly control light emission of electron emission regions using a resistive layer and minimize or reduce a line resistance of a first electrode by enlarging an effective width of the first electrode, and an electron emission display having the electron emission device.

In an exemplary embodiment of the present invention, an electron emission device includes a substrate, a cathode electrode disposed on the substrate, and an electron emission region electrically connected to the cathode electrode. The cathode electrode includes a sub-electrode disposed on the substrate, a sub-insulation layer disposed on the sub-electrode, a main electrode disposed on the sub-electrode and having an opening for exposing a portion of the sub-insulation layer at each of a plurality of unit pixels, a plurality of isolation electrodes disposed on the sub-insulation layer in the opening of the main electrode and spaced apart from the main electrode, and a resistive layer disposed between the main electrode and the isolation electrodes to electrically connect the main electrode to the isolation electrodes.

The sub-insulation layer may be formed to correspond to each of the unit pixels.

The isolation electrodes may be disposed in a line along a length of the main electrode, and the resistive layer may be disposed between the main electrode and the isolation electrodes at both sides of the isolation electrodes.

The electron emission device may further include a gate electrode insulated from the cathode electrode.

The electron emission device may further include a focusing electrode disposed above and insulated from the cathode electrode and the gate electrode.

The electron emission regions may include a material selected from the group consisting of carbon nanotubes, graphite, graphite nanofibers, diamonds, diamond-like carbon, $C_{60}$, silicon nanowires, and combinations thereof.

In another exemplary embodiment of the present invention, an electron emission display includes first and second substrates facing each other, a cathode electrode disposed on the first substrate, an electron emission region electrically connected to the cathode electrode, and a light emission unit disposed on the second substrate. The cathode electrode includes a sub-electrode disposed on the first substrate, a sub-insulation layer disposed on the sub-electrode, a main electrode disposed on the sub-electrode and having an opening for exposing a portion of the sub-insulation layer at each of a plurality of unit pixels, a plurality of isolation electrodes disposed on the sub-insulation layer in the opening of the main electrode and spaced apart from the main electrode, and a resistive layer disposed between the main electrode and the isolation electrodes to electrically connect the main electrode to the isolation electrodes.

The electron emission display may further include a gate electrode disposed to cross the cathode electrode, an insulation layer interposed between the gate electrode and the cathode electrode, and a focusing electrode disposed above and insulated from the cathode and gate electrodes.

The light emission unit may include a phosphor layer disposed on the second substrate and an anode electrode disposed on the second substrate and connected to the phosphor layer.

BRIEF DESCRIPTION OF THE DRAWINGS

These and/or other aspects and features of the invention will become apparent and more readily appreciated from the following description of embodiments of the invention, taken in conjunction with the accompanying drawings of which.

DETAILED DESCRIPTION

Figure 1:
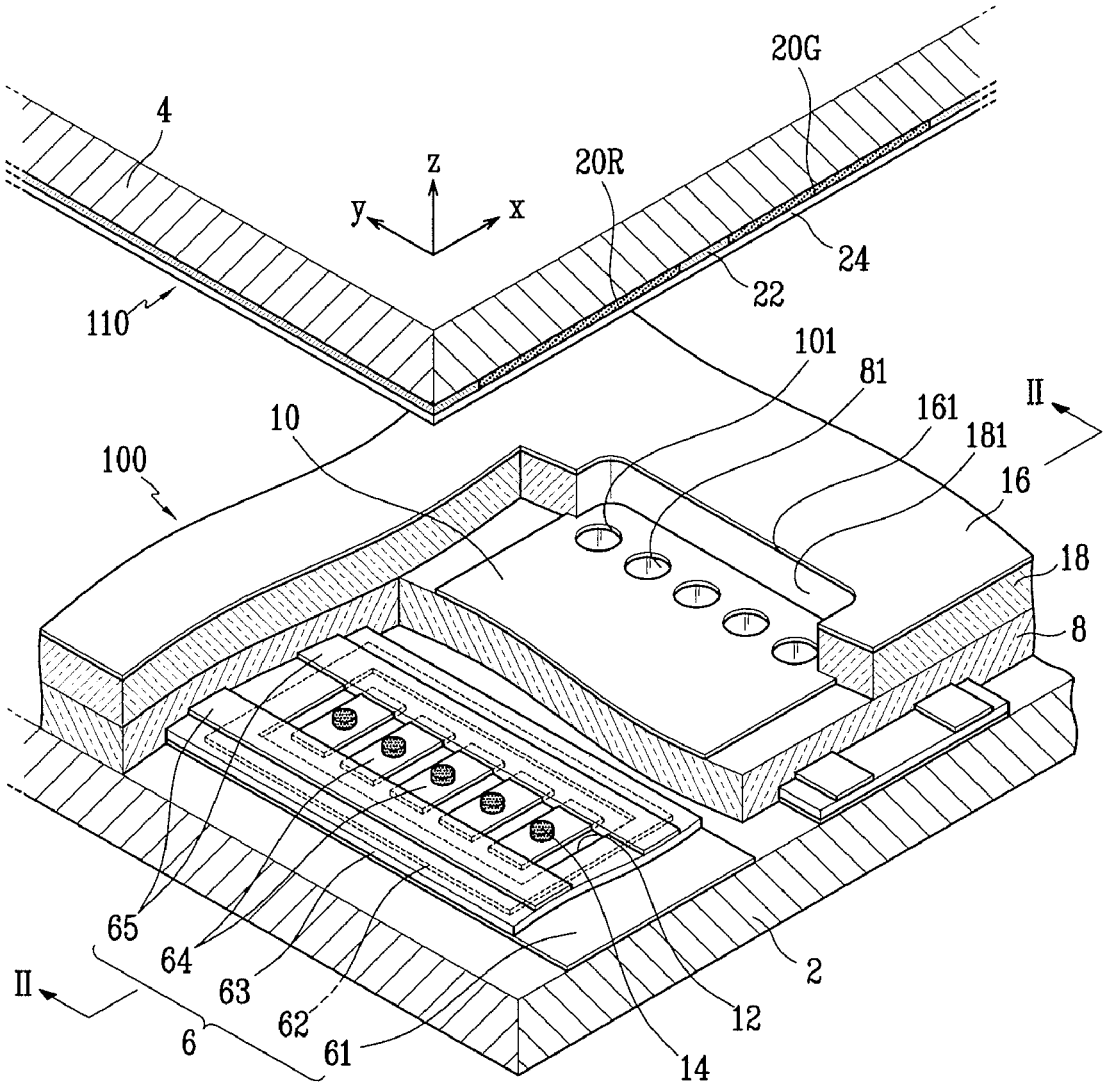
FIG. 1 is a partially cutaway exploded perspective view of an electron emission display according to an embodiment of the present invention.

Reference will now be made in detail to embodiments of the invention, examples of which are shown in the accompanying drawings, wherein like reference numerals refer to like elements throughout. The embodiments are described below in order to explain the invention by referring to the figures.

Figure 2:
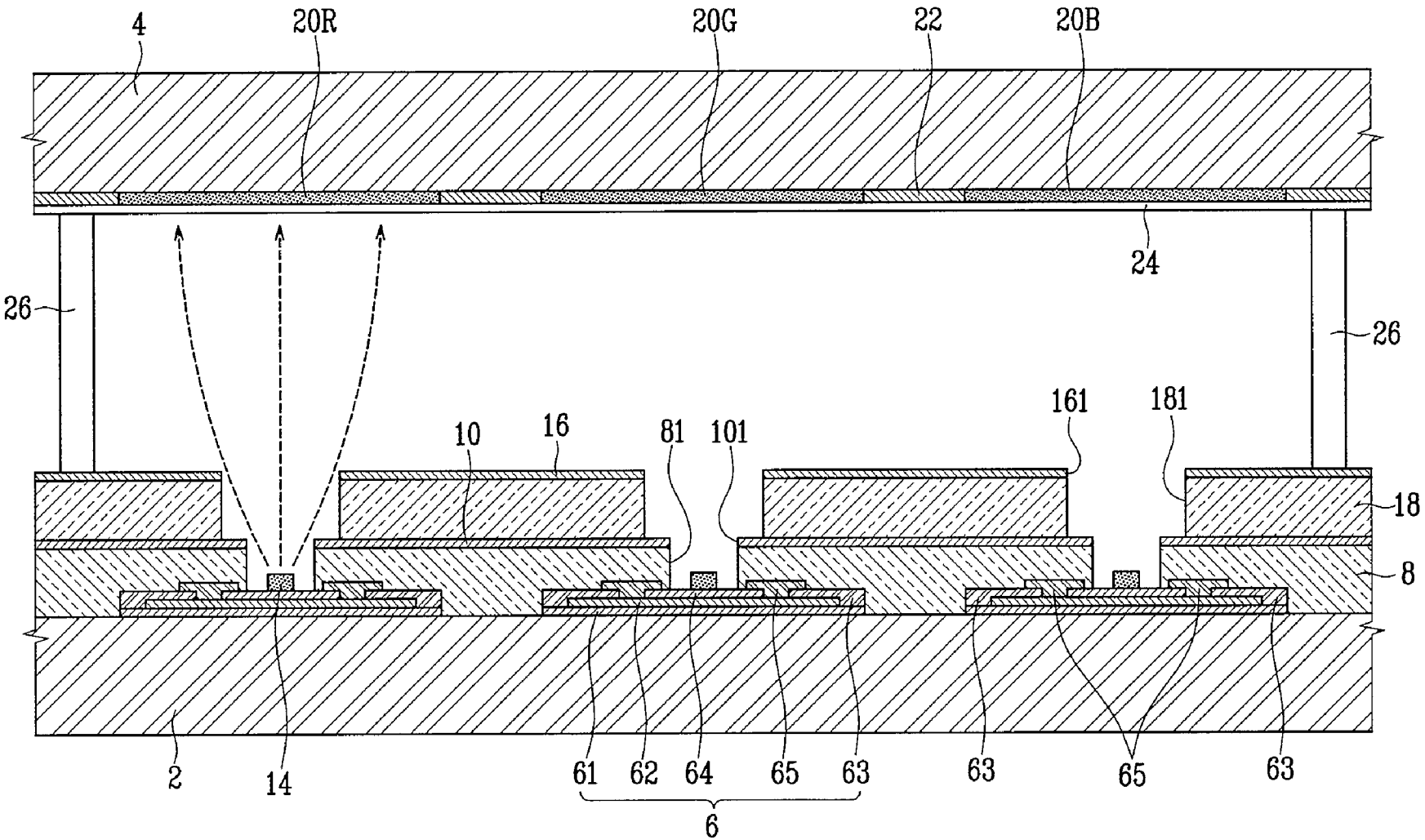
FIG. 2 is a sectional view taken along the line II-II of FIG. 1.

FIGS. 1 and 2 show an electron emission display according to an embodiment of the present invention.

Referring first to FIGS. 1 and 2, an electron emission display includes first and second substrates 2 and 4 facing each other at a certain interval (which may be predetermined). A sealing member is provided at peripheries of the first and second substrates 2 and 4 to seal them together. A space defined by the first and second substrates 2 and 4 and the sealing member is exhausted (or evacuated) to form a vacuum envelope having a vacuum pressure of about $10^{-6}$ Torr.

A plurality of electron emission elements are arrayed on a surface of the first substrate 2 facing the second substrate 4 to form an electron emission unit 100. The electron emission unit 100 is combined with a light emission unit 110 provided on the second substrate 4 to form the electron emission display.

The vacuum envelope may be applied to an electron emission display having an array of Field Emitter Array (FEA), Surface Conduction Emitter (SCE), Metal-Insulator-Metal (MIM), or Metal-insulator-Semiconductor (MIS) elements. By way of example, an electron emission display having an array of FEA elements will be described below. However, embodiments of the electron emission display are not limited thereto.

As shown in FIG. 1, a plurality of cathode electrodes 6 are arranged on the first substrate 2 in a striped pattern to extend along a first direction (e.g., a y-axis of FIG. 1).

A first insulation layer 8 is formed on the first substrate 2 to cover the cathode electrodes 6. A plurality of gate electrodes 10 are formed on the first insulation layer 8 in a striped pattern to extend along a second direction (e.g., an x-axis in FIG. 1) crossing the first direction at a right angle.

Each area where the cathode electrodes 6 are crossed by the gate electrodes 10 defines a unit pixel. One or more electron emission regions 14 are formed on the cathode electrodes 6 at each unit pixel.

Each of the cathode electrodes 6 includes a sub-electrode 61 formed on the first substrate 2 in a striped pattern, a sub-insulation layer 62 formed on the sub-electrode 61 and having a width less than that of the sub-electrode 61, a main electrode 63 formed on the sub-electrode 61 and the sub-insulation layer 62 and having an opening 12 for exposing a portion of the sub-insulation layer 62 at each unit pixel, a plurality of isolation electrodes 64 formed on the sub-insulation layer 62 in the opening 12 of the main electrode 63 and spaced apart from the main electrode 63, and a resistive layer 65 for connecting the main electrode 63 to the isolation electrodes 64 at both sides (or ends) of the isolation electrodes 64.

In one embodiment, the sub-electrode 61 does not have any openings (i.e., the sub-electrode 61 has a substantially planar surface) and is formed in a striped pattern having a substantially uniform width. In one embodiment, the sub-electrode 61 has a line resistance smaller than that of other members of the cathode electrodes 6 (e.g., the main electrode 63) to reduce (or compensate for) a line resistance of the main electrode 63. In one embodiment, the sub-electrode 61 includes a metal layer. The metal layer may be conductive.

The sub-insulation layer 62 is formed to extend along a length of the sub-electrode 61 in a striped pattern having a width less than that of the sub-electrode 61 to partially expose a surface of the sub-electrode 61 or is partially formed at each unit pixel. In one embodiment, the sub-insulation layer 62 partially exposes a surface of the sub-electrode 61. In one embodiment, the sub-insulation layer 62 is formed at each unit pixel, thereby increasing a contact area between the main electrode 63 and the sub-electrode 61 to effectively reduce the line resistance of the main electrode 63.

The main electrode 63 electrically contacts the sub-electrode 61 and has the opening 12 corresponding to a unit pixel. Although an effective width of the main electrode 63 (i.e., a main electrode width for contributing to a current flow in a unit pixel) is thereby reduced, the line resistance thereof is also reduced by the sub-electrode 61, thereby suppressing or reducing a voltage drop in the cathode electrode 6.

As shown in FIG. 1, the isolation electrodes 64 are arranged on the sub-insulation layer 62 in a line along a length of the main electrode 63. One electron emission region 14 is formed on each isolation electrode 64. The resistive layer 65 is positioned on both sides of the isolation electrodes 64 to extend along the first direction (e.g., the y-axis of FIG. 1).

The resistive layer 65 connects the isolation electrodes 64 with the main (or second) electrode 63. That is, the resistive layer 65 is formed on both side edges of the isolation electrodes 64 while contacting both sides of the main (or second) electrode 63. In one embodiment, the resistive layer 65 includes a material having a resistivity within a range from about 10,000 to about 100,000 Ωcm. As such, the resistance of the resistive layer 65 is less than that of other members of the cathode electrode 6. By way of example, the resistive layer 65 may include amorphous silicon doped with P-type or N-type impurities.

The resistive layer 65 is formed to partially cover surfaces of the main electrode 63 and the isolation electrodes 64 to reduce a contact resistance with the main electrode 63 and the isolation electrodes 64. A thickness of the resistive layer 65 may be about 2,000 Å (0.2 μm).

In one embodiment, the main electrode 63 receives a drive voltage from an external drive circuit unit and applies the drive voltage to the isolation electrodes 64 through the resistive layer 65. The resistivity between the main electrode 63 and the isolation electrodes 64 can be controlled by varying a distance between the main electrode 63 and the isolation electrodes 64.

Although, in the drawings, the opening 12 and the isolation electrodes 64 are shown as having rectangular shapes, embodiments of the present invention are not limited thereto.

The electron emission regions 14 may be formed of a material which emits electrons when an electric field is applied thereto in a vacuum atmosphere. By way of example, the material may include a carbonaceous material and/or a nanometer-sized material. By way of example, the electron emission regions 14 may be formed of carbon nanotubes, graphite, graphite nanofibers, diamonds, diamond-like carbon, $C_{60}$, silicon nanowires, or combinations thereof. Alternatively, the electron emission regions 14 may be formed of a Mo-based or a Si-based material. Here, the electron emission regions 14 may have a shape with a pointed-tip structure.

The first insulation layer 8 is formed on the first substrate 2 to cover the cathode electrodes 6. The gate electrodes 10 are formed on the first insulation layer 8 in a striped pattern to extend along the second direction (e.g., the x-axis in FIG. 1) crossing the cathode electrodes 6 at right angles.

As shown in FIGS. 1 and 2, first and second openings 81 and 101 corresponding to the electron emission regions 14 are formed on the first insulation layer 8 and the gate electrodes 10, respectively, to expose the electron emission regions 14. That is, the electron emission regions 14 are disposed on the cathode electrodes 6 in the first and second openings 81 and 101 of the first insulation layer 8 and the gate electrodes 10, respectively. As shown in FIGS. 1 and 2, each of the first and second openings 81 and 101 and the electron emission regions 14 is formed to have a circular shape. However, embodiments of the present invention are not limited thereto.

In addition, a second insulation layer 18 is formed on the first insulation layer 8 to cover the gate electrodes 10, and a focusing electrode 16 is formed on the second insulation layer 18. That is, the gate electrodes 10 are insulated from the focusing electrode 16 by the second insulation layer 18. In one embodiment, the focusing electrode 16 includes a single layer formed on the second insulation layer 18 and has a certain size (which may be predetermined).

Third and fourth openings 161 and 181 through which electron beams pass are formed through the focusing electrode 16 and the second insulation layer 18, respectively.

Each of the third openings 161 of the focusing electrode 16 corresponds to one of the unit pixels to focus the electrons emitted from the one of the unit pixels. Alternatively, each of the third openings 161 may correspond to one of the electron emission regions 14, and each of the fourth openings 181 may be formed to correspond to all of the third openings 161 located at each unit pixel.

Phosphor layers 20 (e.g., red, green and blue phosphor layers 20R, 20G and 20B) are formed on a surface of the second substrate 4 facing the first substrate 2, and a black layer 22 for enhancing a contrast of a screen (or an image) is formed on the second substrate 4 between the phosphor layers 20. The phosphor layers 20 may be formed to correspond to the unit pixels defined on the first substrate 2.

An anode electrode 24 formed of a conductive material such as aluminum is formed on the phosphor and black layers 20 and 22. The anode electrode 24 increases a screen luminance by receiving a high voltage for accelerating electron beams and reflecting visible light rays radiated from the phosphor layers 20 to the first substrate 2 back toward the second substrate 4.

Alternatively, the anode electrode 24 may be formed of a transparent conductive material, such as Indium Tin Oxide (ITO), instead of a metallic material. Here, the anode electrode 24 is placed on the second substrate, and the phosphor and black layers 20 and 22 are formed on the anode electrode 24. Alternatively, the anode electrode 24 may include a transparent conductive layer and a metallic layer.

Disposed between the first and second substrates 2 and 4 are spacers 26 for uniformly maintaining a gap between the first and second substrates 2 and 4. The spacers 26 are disposed to correspond to the black layer 22 so as not to interfere with the light emission of the phosphor layers 20.

The above-described electron emission display is driven when a certain voltage (which may be predetermined) is applied to the cathode, gate, focusing, and anode electrodes 6, 10, 16, and 24.

By way of example, one of the cathode electrodes 6 or the gate electrodes 10 serves as scan electrodes for receiving a scan drive voltage, and the other of the cathode electrodes 6 or the gate electrodes 10 functions as data electrodes for receiving a data drive voltage.

By way of example, the focusing electrode 16 receives a negative direct current (DC) voltage in a range from 0 to tens of volts. Also by way of example, the anode electrode 24 receives a positive DC voltage in a range from hundreds to thousands of volts for accelerating the electron beams.

Electric fields are formed around the electron emission regions 14 at unit pixels where a voltage difference between the cathode and gate electrodes 6 and 10 is equal to or higher than a threshold value, and thus electrons are emitted from the electron emission regions 14. The emitted electrons are converged while passing through the third openings 161 of the focusing electrode 16 and strike the corresponding phosphor layers 20 due to attraction to the high voltage applied to the anode electrode 24, thereby exciting the phosphor layers 20.

During the above-described driving operation, the resistive layer 65 applies a drive voltage to the electron emission regions substantially evenly to improve the uniformity of light emission. In addition, the sub-electrode 61 reduces the line resistance of the main electrode 63 to minimize or reduce the voltage drop of the cathode electrode.

As described above, according to embodiments of the present invention, since the line resistance of the cathode electrode can be minimized or reduced by the sub-electrode, the voltage drop of the cathode electrode can be suppressed or reduced. Therefore, the light emission uniformity of the phosphor layers corresponding to a length of the cathode electrode can be enhanced, thereby improving the display (or image) quality.

Although exemplary embodiments of the present invention have been shown and described, it will be appreciated by those skilled in the art that changes may be made in these embodiments without departing from the principles and spirit of the invention, the scope of which is defined in the claims and their equivalents.

What is claimed is:

1. An electron emission device comprising:
- a substrate;
- a cathode electrode disposed on the substrate; and
- an electron emission region electrically connected to the cathode electrode,
- wherein the cathode electrode comprises:
  - a sub-electrode disposed on the substrate;
  - a sub-insulation layer disposed on the sub-electrode and having a width less than that of the sub-electrode;
  - a main electrode disposed on the sub-electrode and having an opening for exposing a portion of the sub-insulation layer at each of a plurality of unit pixels;
  - a plurality of isolation electrodes disposed on the sub-insulation layer in the opening of the main electrode and spaced apart from the main electrode; and
  - a resistive layer disposed between the main electrode and the isolation electrodes to electrically connect the main electrode to the isolation electrodes;
  - wherein the electron emission region is directly on and in contact with a corresponding one of the isolation electrodes.

2. The electron emission device of claim 1, wherein the sub-insulation layer is formed to correspond to each of the unit pixels.

3. The electron emission device of claim 1, wherein the isolation electrodes are disposed in a line along a length of the main electrode, and wherein the resistive layer is disposed between the main electrode and the isolation electrodes at both sides of the isolation electrodes.

4. The electron emission device of claim 1, further comprising a gate electrode insulated from the cathode electrode.

5. The electron emission device of claim 4, further comprising a focusing electrode disposed above and insulated from the cathode electrode and the gate electrode.

6. The electron emission device of claim 1, wherein the electron emission region includes a material selected from the group consisting of carbon nanotubes, graphite, graphite nanofibers, diamonds, diamond-like carbon, $C_{60}$, silicon nanowires, and combinations thereof.

7. The electron emission device of claim 1, wherein the sub-insulation layer has a width smaller than a width of the sub-electrode.

8. The electron emission device of claim 1, wherein the sub-electrode has a line resistance smaller than a line resistance of the main electrode.

9. The electron emission device of claim 8, wherein the sub-electrode has a substantially planar surface.

10. The electron emission device of claim 8, wherein the sub-electrode includes a conductive metal layer.

11. An electron emission display comprising:

first and second substrates facing each other;

a cathode electrode disposed on the first substrate;

an electron emission region electrically connected to the cathode electrode; and a light emission unit disposed on the second substrate, wherein the cathode electrode comprises:

a sub-electrode disposed on the first substrate;

a sub-insulation layer disposed on the sub-electrode and having a width less than that of the sub-electrode;

a main electrode disposed on the sub-electrode and having an opening for exposing a portion of the sub-insulation layer at each of a plurality of unit pixels;

a plurality of isolation electrodes disposed on the sub-insulation layer in the opening of the main electrode and spaced apart from the main electrode; and a resistive layer disposed between the main electrode and the isolation electrodes to electrically connect the main electrode to the isolation electrodes;

wherein the electron emission region is directly on and in contact with a corresponding one of the isolation electrodes.

12. The electron emission display of claim 11, wherein the sub-insulation layer is formed to correspond to each of the unit pixels.

13. The electron emission display of claim 11, wherein the isolation electrodes are disposed in a line along a length of the main electrode, and wherein the resistive layer is disposed between the main electrode and the isolation electrodes at both sides of the isolation electrodes.

14. The electron emission display of claim 11, further comprising a gate electrode insulated from the cathode electrode.

15. The electron emission display of claim 11, further comprising:

a gate electrode disposed to cross the cathode electrode;

an insulation layer interposed between the gate electrode and the cathode electrode; and a focusing electrode disposed above and insulated from the cathode and gate electrodes.

16. The electron emission display of claim 11, wherein the light emission unit comprises:

a phosphor layer disposed on the second substrate; and an anode electrode disposed on the second substrate and connected to the phosphor layer.

17. The electron emission display of claim 11, wherein the sub-insulation layer has a width smaller than a width of the sub-electrode.

18. The electron emission display of claim 11, wherein the sub-electrode has a line resistance smaller than a line resistance of the main electrode.

19. The electron emission display of claim 18, wherein the sub-electrode has a substantially planar surface.

20. The electron emission display of claim 18, wherein the sub-electrode includes a conductive metal layer.

* * * * *